US008714171B1

(12) United States Patent
Haygood

(10) Patent No.: US 8,714,171 B1
(45) Date of Patent: May 6, 2014

(54) WALKER HANDRAIL EXTENSION

(71) Applicant: Gary E. Haygood, Kilgore, TX (US)

(72) Inventor: Gary E. Haygood, Kilgore, TX (US)

( * ) Notice: Subject to any disclaimer, the term of this patent is extended or adjusted under 35 U.S.C. 154(b) by 0 days.

(21) Appl. No.: 14/060,643

(22) Filed: Oct. 23, 2013

Related U.S. Application Data

(60) Provisional application No. 61/734,341, filed on Dec. 6, 2012.

(51) Int. Cl.
*A45B 9/00* (2006.01)

(52) U.S. Cl.
USPC ..... 135/66; 135/74

(58) Field of Classification Search
CPC .... A61H 3/00; A61H 2003/00; A61G 7/1038
USPC ..... 135/66, 67, 74, 76
See application file for complete search history.

(56) References Cited

U.S. PATENT DOCUMENTS

| | | | | | |
|---|---|---|---|---|---|
| 4,240,184 | A | * | 12/1980 | Delhees et al. | 24/279 |
| 4,748,994 | A | * | 6/1988 | Schultz et al. | 135/67 |
| 5,005,599 | A | * | 4/1991 | Cunningham | 135/67 |
| 5,117,516 | A | | 6/1992 | Penner | |
| 5,123,126 | A | | 6/1992 | Vincent | |
| 5,305,773 | A | | 4/1994 | Browning | |
| 5,354,022 | A | | 10/1994 | Coonrod | |
| 5,445,174 | A | | 8/1995 | Cunningham | |
| 5,785,070 | A | | 7/1998 | Block et al. | |
| D407,672 | S | | 4/1999 | Wells | |
| 6,082,384 | A | | 7/2000 | Cheng | |
| 6,135,131 | A | | 10/2000 | Downing | |
| 6,338,354 | B1 | | 1/2002 | Alexander | |
| 6,733,018 | B2 | | 5/2004 | Razon | |
| D506,419 | S | | 6/2005 | Coster | |
| 6,920,667 | B2 | | 7/2005 | Joesten | |
| 6,990,990 | B2 | * | 1/2006 | Wilensky et al. | 135/67 |
| D523,789 | S | | 6/2006 | Caselberry | |
| 7,182,179 | B2 | | 2/2007 | Tolfsen | |
| 7,377,285 | B2 | | 5/2008 | Karasin et al. | |
| 7,779,850 | B2 | * | 8/2010 | Caldwell | 135/67 |
| 8,166,987 | B2 | | 5/2012 | Weaver | |
| 8,234,755 | B1 | | 8/2012 | Brand et al. | |
| 2008/0121259 | A1 | * | 5/2008 | Weaver | 135/67 |
| 2010/0100013 | A1 | * | 4/2010 | Hu et al. | 600/595 |
| 2012/0042918 | A1 | | 2/2012 | Tessier | |

* cited by examiner

*Primary Examiner* — Noah Chandler Hawk
(74) *Attorney, Agent, or Firm* — John Lindsay

(57) ABSTRACT

The present invention is directed to a device for attachment to a walker which facilitates a user rising from a seated position or returning to a seated position. The device includes a clamp, a primary support region, an angular support, and a foot. The clamp further includes a perimeter dimensioned for receipt of a vertical support of a walker. The clamp further includes a mechanical fastener assembly for secure joinder to the first end of a primary support. The primary support includes a rigid length of material extending distally from the first end. The second end of the primary support is coupled to a first end of an angular support, the angular support extends away from the primary support where its second end is joined to a foot. The foot includes a bottom surface configured to bear load and transfer load to a seating surface.

16 Claims, 7 Drawing Sheets

WALKER HANDRAIL EXTENSION

PRIORITY

The present invention claims priority to provisional application Ser. No. 61/734,341, which has a filing date of Dec. 6, 2012, and is incorporated by reference.

BACKGROUND

1. Field of the Invention

The present invention relates to a health mobility device, more specifically to a device to for assisting a disabled person to rise from or be seated to an article of furniture.

2. Description of the Related Art

Many people suffer from medical conditions such as arthritis, muscular injury, muscular disease, back injuries, knee injuries, obesity, or simply advanced age, which makes moving from a sitting to a standing position or a standing to a sitting position difficult. It is very trying for people who suffer from such conditions to sit down and rise from chairs, beds, sofas, and wheelchairs. As a result, disabled people often remain seated when, in fact, rising from a chair or a bed and walking would provide exercise to the disabled person. It can be even more difficult rising from the chair or bed into the various configurations of walkers. Thus, the person may be stranded or require third party assistance at the destination.

There are a number of devices which have been utilized to assist disabled persons to sit and to rise. However, these devices have generally been bulky, cumbersome, or have not been of sturdy construction to prevent a disabled person from strenuous action when using the device. Additionally, some devices are incompatible or have limited compatibility in use with other disability aids such as wheelchairs and walkers.

Thus a need exists for a device which allows a person to rise from a seat to a standing position or to sit from a standing position to a wide configuration of walkers from a wide variety of surfaces with minimal strain.

SUMMARY

The present invention is directed to a device for attachment to a walker which facilitates a user rising from a seated position or returning to a seated position. The device includes a clamp, a primary support region, an angular support, and a foot. The clamp further comprises a perimeter dimensioned for receipt of a vertical support of a walker. The clamp further includes a mechanical fastener assembly for secure joinder to the first end of a primary support. The primary support includes a rigid length of material extending distally from the first end. The second end of the primary support is coupled to a first end of an angular support, the an angular support extends away from the primary support where its second end is joined to a foot. The foot includes a bottom surface configured to bear load and transfer load to a seating surface.

These and other features, aspects, and advantages of the invention will become better understood with reference to the following description, and accompanying drawings.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 5:
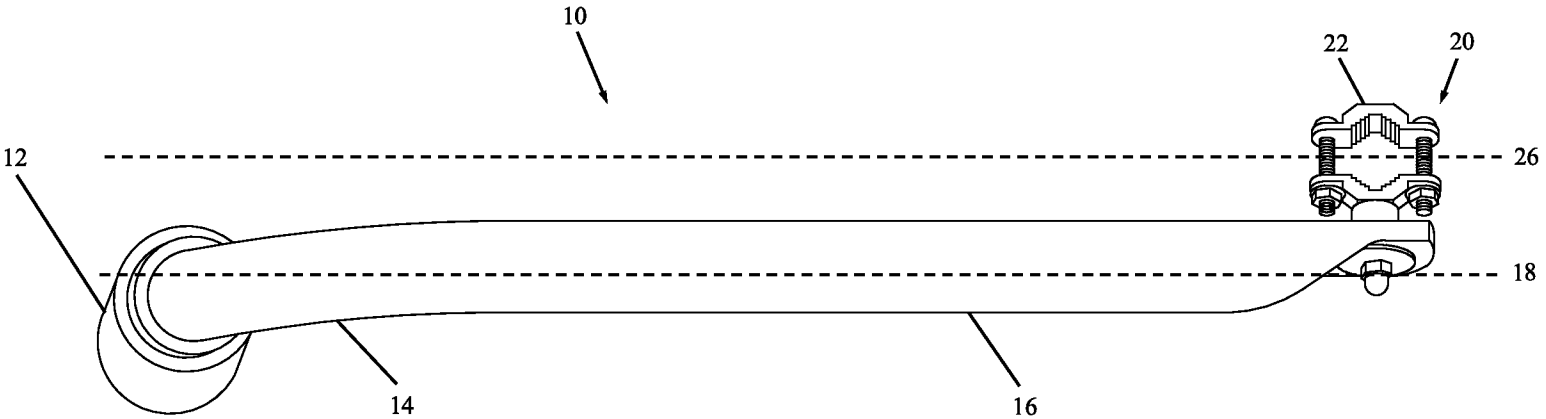
FIG. 5 depicts a top perspective view of the device of the embodiment of FIG. 1.

The present invention is directed to a device for removable attachment to a walker which aids a person in rising from a seated to a standing position in order to engage a walker or in sitting from a standing position in order to disengage from a walker. FIG. 5 illustrates an embodiment of the walker handrail extension 10. Illustrated are a clamp 20, a primary support 16, and an angular support 14, and a foot 12. In exemplary operation, at least one walker handrail extension 10 is removably secured to a walker 40.

Figure 1:
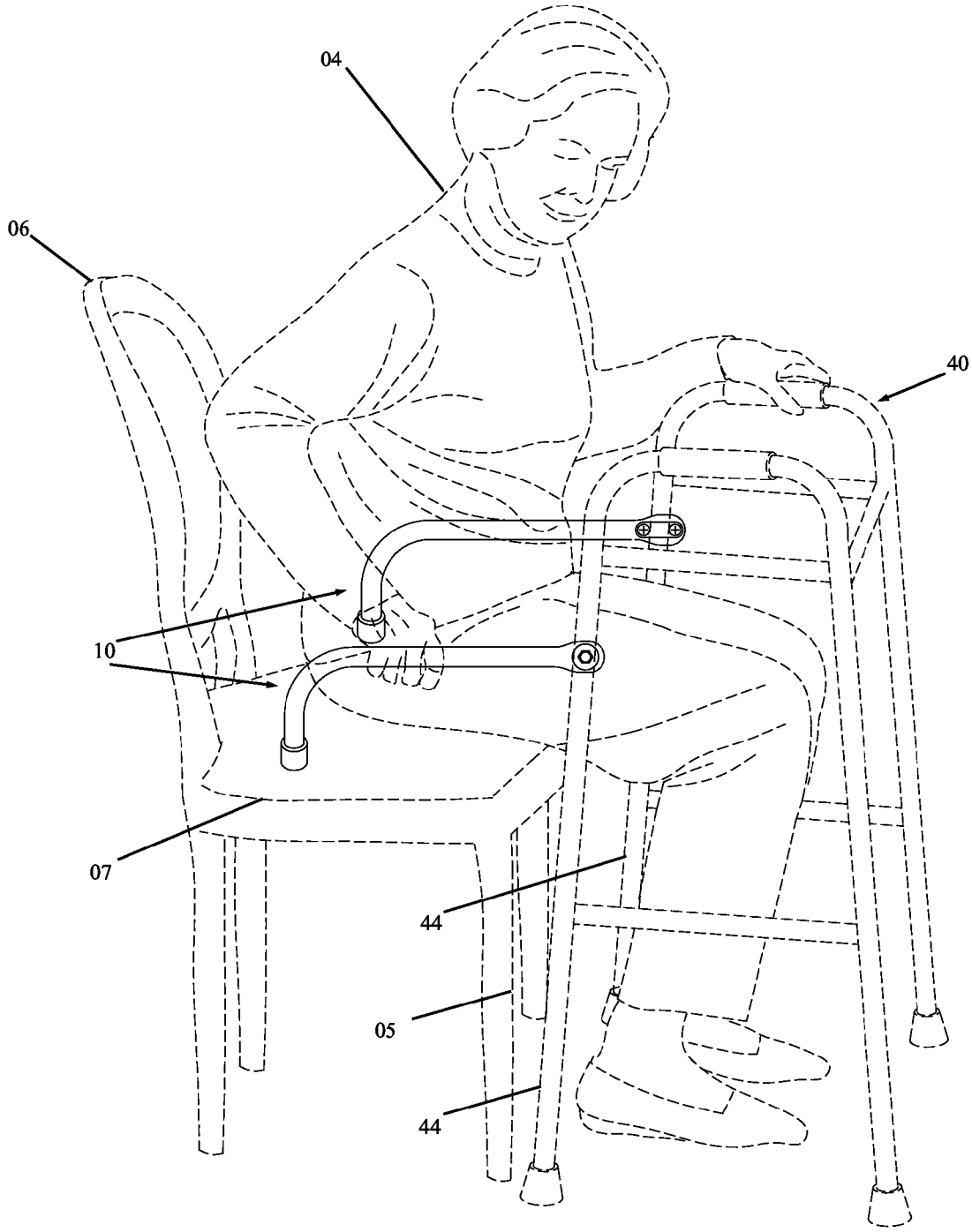
FIG. 1 depicts a side perspective view of an embodiment of the current invention as they may exist in use.

Referring to FIG. 1, the walker handrail extension 10 is a device which aids a person 04 in rising from a seated to a standing position in order to engage a walker 40 or in sitting from a standing position in order to disengage from a walker 40. The person 04 is commonly rising from or sitting on an article of furniture 06 or similar article. Typical articles include a chair, a couch, bed, chest, wheelchair, or the like. An upper section of the article 06 presents a seating surface 07. Adjacent and extending downwardly from the seating surface 07 is a front face 05. The person 04 is typically seated with the buttocks and upper legs abutting the seating surface 07 while the lower legs drape over the front face 05.

Figure 2:
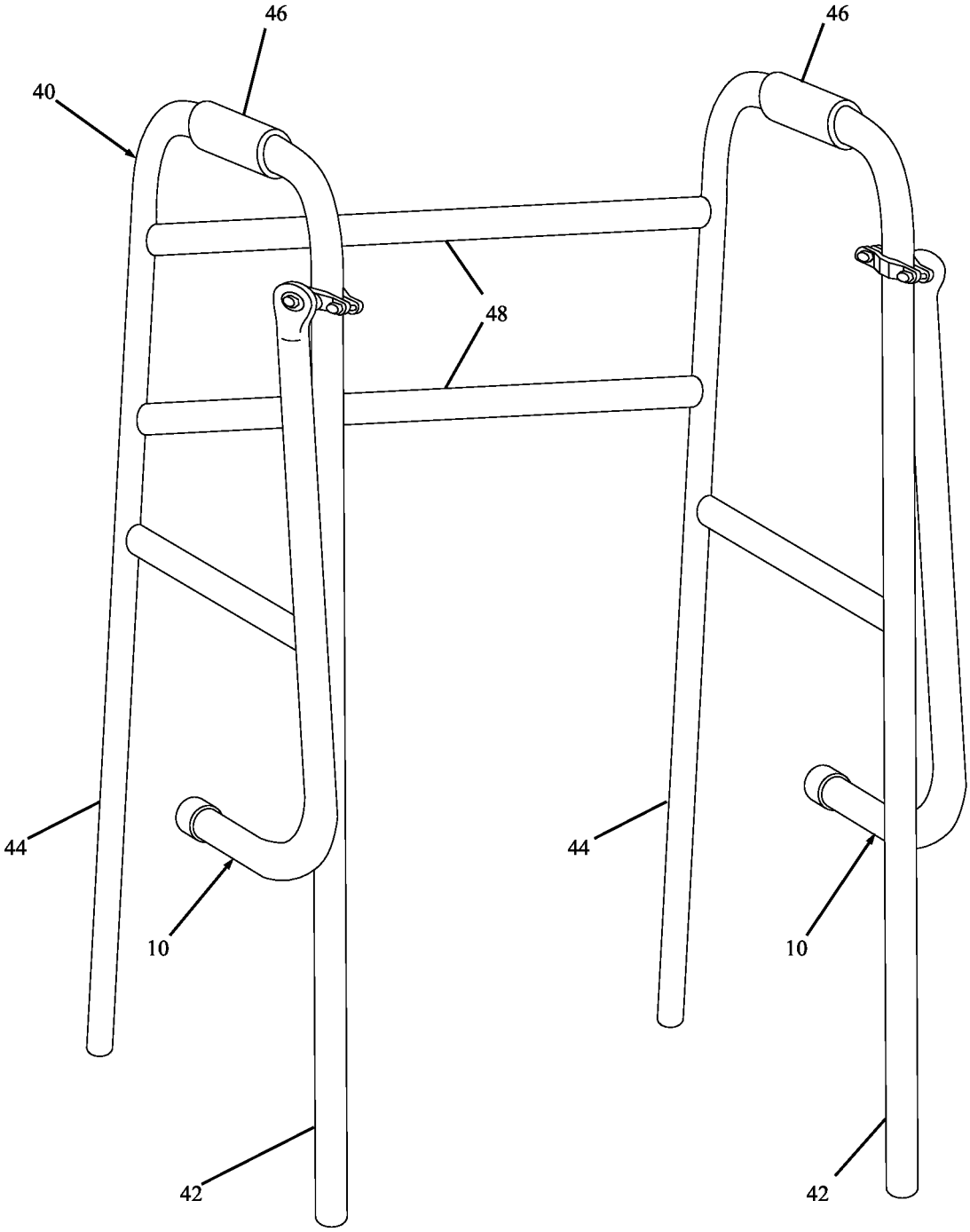
FIG. 2 depicts a front perspective view of an alternate embodiment of the current invention.

Referring to FIG. 2, a walker 40 is illustrated. The walker 40 is operable to aid a person 04 in maintaining balance or stability while walking and includes vertical supports, here a pair of rear legs 44, a pair of front legs 42, and at least one crossbar 48. The rear legs 44 extend upwardly and are spaced apart in normal use. In the exemplary configuration, a portion of each rear leg 44 is tubular. Extending outwardly from each rear leg 44 is a grip 46 where a person 04 may hold the walker 40. Further outward from each grip 44 is a front leg 42. Each of the front legs 42 extends upwardly and is spaced apart in normal use. The crossbar 48 is joined to the front legs 42, spanning them. A partial perimeter is defined by the rear legs 44, grips 46, front legs 42, and crossbar 48 within which a person 04 may stand and engage the walker 40. It is to be understood that this is a basic configuration of a walker 40. One skilled in the art would appreciate that a walker may take different configurations. For example, a walker 40 may be vertically or horizontally adjustable or collapsible. As another example, the illustrated walker's 40 rear legs 44 are slightly less than orthogonal relative to the ground. The rear legs 44 may be configured at a more acute angle.

Figure 4:
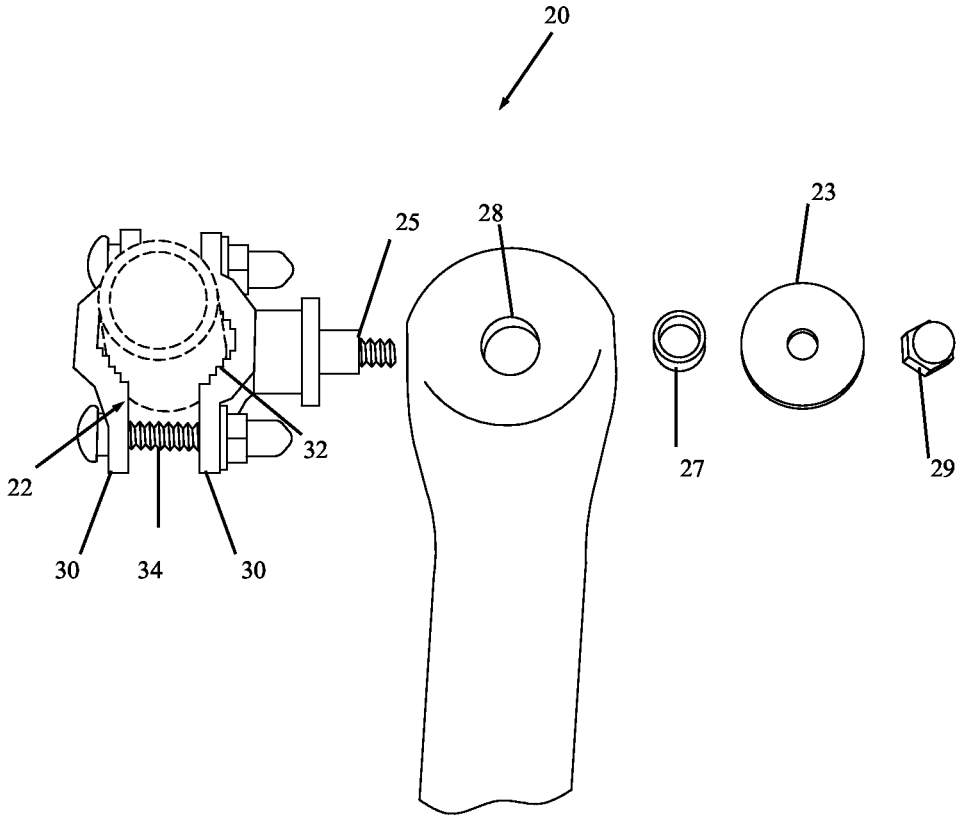
FIG. 4 depicts a partial exploded view of a clamp of FIG. 1.

Referring to FIG. 4, the walker handrail extension 10 includes at least one clamp 20 in order to secure the device 10 to a walker 40. In the exemplary device 10, the clamp 20 is configured to be removably joined to the walker 40. The clamp 20 includes a perimeter 20 and a mechanical fastener assembly 24. The perimeter 20 may be formed by a combination of rigid material which presents an interior boundary surface for secure contact with a walker 40 vertical support, preferably a rear leg 44. The interior surface defines the perimeter 22 and the perimeter 22 bounds an aperture 28 through which the leg 44 may be removably placed. The perimeter 22 is configured to maintain its position its secured position relative position with the leg 44 under load condition. Secure perimeter 22 configurations include compressive, frictional, or other structures known in the arts. Representative frictional structures include a textured interior surface or a hook and loop fastener, where one side of the hook and loop is secured to the interior surface and the other is secured to the vertical support. As illustrated, the perimeter 22 includes opposing plates 30 and fasteners 34. The interior surface of the plates 30 includes ribs 32. Fasteners 34 joined to opposing ends of the plates 30 complete and secure the perimeter 22.

Figure 7:
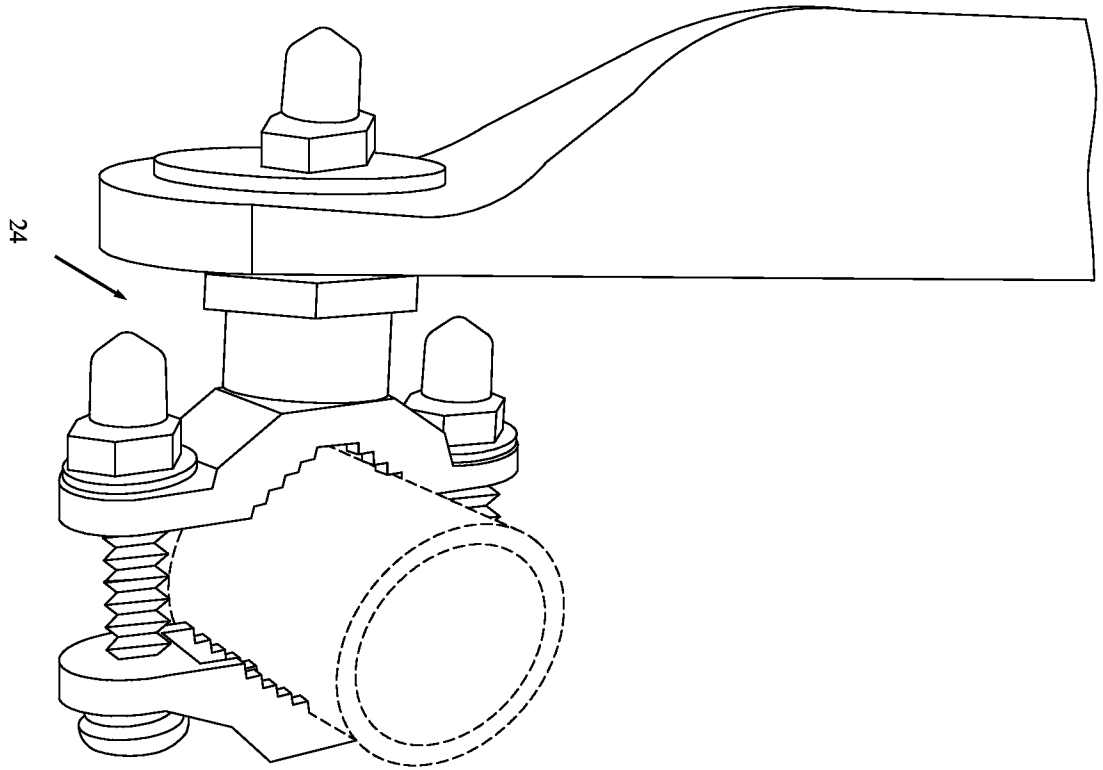
FIG. 7 depicts a top view of a configuration of a clamp of FIG. 1.

The clamp 20 further includes a mechanical fastener assembly 24 operable to affix the clamp 20 to the primary support 16. The mechanical fastener assembly 24 includes a fastener and a corresponding bore. In the exemplary device 10, the mechanical fastener assembly 24 is rotatably affixed to the primary support 16, preferably rotating in a vertically oriented plane. In the illustrated configuration, the mechanical fastener assembly 24 includes a shaft 25, a bore 28, a sleeve 27, a washer 23, and a nut 29. The sleeve 27 is disposed in the bore 28 and the shaft 25 is placed therethrough. The nut 29 is joined to the end of the shaft 25. An assembled, illustrated clamp 20 is shown in FIG. 7.

Figure 6:
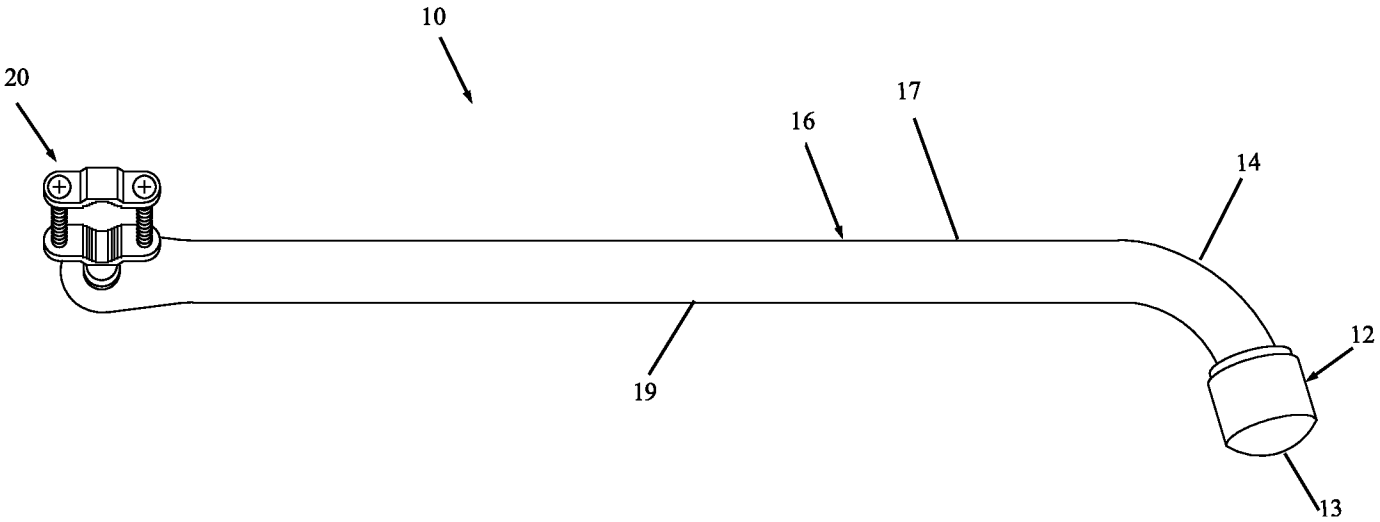
FIG. 6 depicts a side perspective view of the device of the embodiment of FIG. 1.

Now referring to FIG. 6, the walker handrail extension 10 includes a primary support 16 where a user 04 can place his or hands, and in turn, the person's load on the device 10. The primary support 16 is a rigid length of material having a first end and a second end. The primary support 16 presents an upper surface 17 and a lower surface 19. The upper surface 17 is dimensioned for placement of the user 04 hands.

As previously disclosed, a first end of the primary support 16 is joined with the clamp 20. Now referring to FIG. 5, the clamp 20 may be joined to the primary support 16 in plural configurations. The primary support 16 presents a first plane 18 along its central axis. The clamp 20 presents a plane 26 along its central axis. In the exemplary configuration, the clamp 20 is joined to the primary support 16 in an angular orientation such that the plane 18 presented by the primary support 16 is adjacent and spaced apart from the plane 26 presented by the clamp 20. In an alternate configuration (not pictured), the clamp 20 is joined to the primary support 16 in a linear orientation such that the plane 18 presented by the primary support 16 is coplanar with the plane 26 presented by the clamp 20.

Referring to FIG. 6, the second end of the primary support 16 is joined to the proximal end of an angular support 14. The angular support 14 is rigid and extends away from the bottom surface 19 of the primary support 16. It is preferably curvilinear but can also employ a sharp bend. The degree of curvature, radius of curvature, and regularity or irregularity of the curve transition are configured for optimal user 04 support, distance from the walker 40, distance from the rear legs 44, distance from the interior space of the walker 40, load transfer characteristics to the foot 12, potential clearance for a seating surface 07, and other factors. For example, the angular support 14 may employ a gradual rise such that the user 04 may employ it as interim support as the hands are moved from the side of the body to the primary support 16 to the grips 46. In the pictured configuration, the angular support 14 incorporates a sharper, curvilinear style of curvature.

Extending from the distal end of the angular support 14 is a foot 12, operable to bear the load of the user 04. The foot 12 presents a bottom surface 13 for contact with a seating surface 07.

Figure 3:
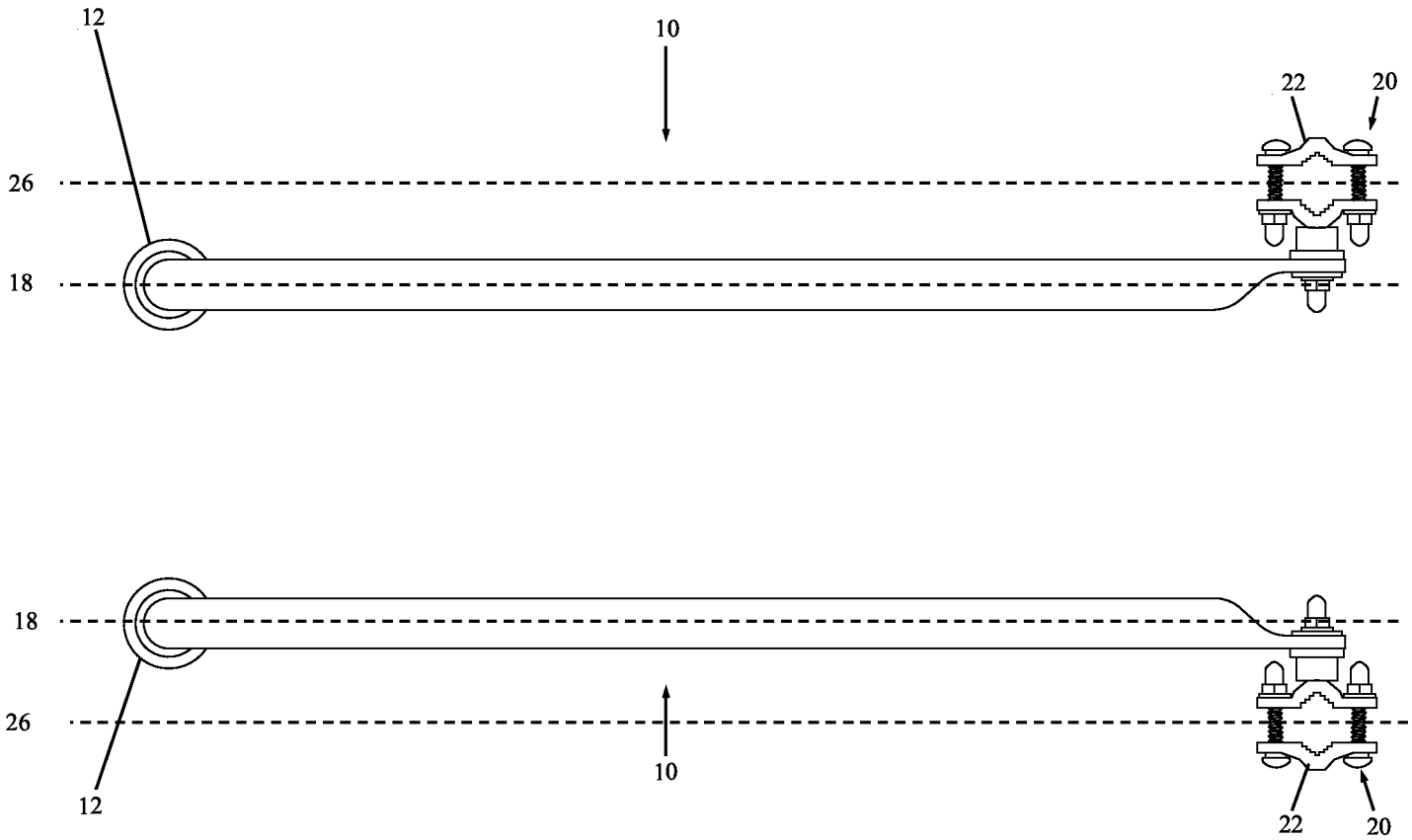
FIG. 3 depicts a top view of a pair of devices of the embodiment of FIG. 1.

Referring to FIGS. 1-3, use of an embodiment of the walker handrail extension 10 is shown with a person 04 rising from a seated position. In exemplary use, two of the walker handrail extensions 10 are employed as shown in FIG. 3. As shown in FIG. 2, the clamp 20 of each walker handrail extension 10 is secured to an opposing rear leg 44 of the walker 40. The walker handrail extensions 10 pivot at the clamps 20 and rest adjacent the rear legs 44. Referring to FIG. 1, the user 02 is seated on the seating surface 07 with legs draped over the front face 05 of the chair. The user 02 orients the walker 40 such that he or she is between the rear legs 44. The user 02 pivots the walker handrail extensions 10 such that the foot 12 is resting on the seating surface 07. The user then grips the primary support 16 and applies force to the device 10 in order to stand and enter the interior perimeter of the walker 40.

Insofar as the description above and the accompanying drawing disclose any additional subject matter that is not within the scope of the single claim below, the inventions are not dedicated to the public and the right to file one or more applications to claim such additional inventions is reserved.

I claim:

1. A device for joinder with a walker, said device comprising:

a clamp, a primary support, an angular support, and a foot;

said clamp further comprising an interior perimeter dimensioned for receipt of an upper section of a vertical support of said walker;

said clamp further comprising a fastener assembly for joinder to a first end of said primary support, wherein said fastener assembly is freely rotatably joined to said primary support with said primary support joined to rotate 360 degrees about said fastener assembly in a vertically oriented plane;

said primary support presenting a substantially linear axis and extending distally to a second end, said second end of said primary support joined to a first end of said angular support;

said angular support extending distally to the lower surface of said primary support, the second end of said angular support joined to said foot; and said foot comprising a bottom surface to bear and transfer load to a seating surface.

2. The device of claim 1, wherein said primary support presents a plane along its central axis, said interior perimeter presents a generally parallel plane, and said clamp is angularly oriented such that said planes are spaced apart and outside the range of planes presented by the vertical support of said walker.

3. The device of claim 1, wherein said primary support presents a plane along its central axis, said interior perimeter presents a generally parallel plane, and said clamp is angularly oriented such that said planes are coplanar.

4. The device of claim 1, wherein said fastener comprises a compressive fastener.

5. The device of claim 1, wherein said fastener comprises a frictional fastener.

6. The device of claim 1, wherein said interior perimeter further comprises ribs.

7. A device for assisting a person to rise from a sitting position to a standing position and for assisting a person to lower from a standing to a sitting position, said device comprising:

a walker, a clamp, a primary support, an angular support, and a foot;

said walker further comprising a first rear leg joined to a first grip, said first grip joined to a first front leg;

said walker further comprising a second rear leg joined to a second grip, said second grip joined to a second front leg;

said walker further comprising a crossbar joining said first front leg to said second front leg;

said clamp further comprising an interior perimeter dimensioned for receipt of an upper section of a rear leg of said walker;

said clamp further comprising a fastener assembly for joinder to a first end of said primary support, wherein said fastener assembly is freely rotatably joined to said primary support with said primary support joined to rotate 360 degrees about said fastener assembly in a vertically oriented plane;

said primary support presenting a substantially linear axis and extending distally to a second end, said second end of said primary support joined to a first end of said angular support;

said angular support extending distally to the lower surface of said primary support, the second end of said angular support joined to said foot; and said foot comprising a bottom surface to bear and transfer load to a seating surface.

8. The device of claim 7, wherein said fastener comprises a compressive fastener.

9. The device of claim 7, wherein said fastener comprises a frictional fastener.

10. The device of claim 7, wherein said interior perimeter further comprises ribs.

11. The device of claim 7, wherein said primary support presents a plane along its central axis, said interior perimeter presents a generally parallel plane, and said clamp is angularly oriented such that said planes are spaced apart and outside the range of planes presented by the vertical support of said walker.

12. The device of claim 7, wherein said primary support presents a plane along its central axis, said interior perimeter presents a generally parallel plane, and said clamp is angularly oriented such that said planes are coplanar.

13. A handrail extension comprising:

a clamp, a primary support, an angular support, and a foot;

said clamp further comprising opposing plates and fasteners, said fasteners joined to opposing ends of said plates presenting an interior perimeter dimensioned for receipt of an upper section of a vertical support of a walker;

said clamp further comprising a fastener assembly for joinder to a first end of said primary support, said fastener assembly including a shaft and a bore in said primary support, said shaft disposed through said bore and secured, wherein said fastener assembly is freely rotatably joined to said primary support with said primary support joined to rotate 360 degrees about said fastener assembly in a vertically oriented plane;

said primary support being elongated and presenting a substantially linear axis and extending distally to a second end, said second end of said primary support joined to a first end of said angular support;

said angular support extending distally to the lower surface of said primary support, the second end of said angular support joined to said foot; and said foot comprising a bottom surface to bear and transfer load to a seating surface.

14. The device of claim 13 wherein said handrail extension is coupled to a walker, said walker comprising a first rear leg joined to a first grip, said first grip joined to a first front leg;

said walker comprising a second rear leg joined to a second grip, said second grip joined to a second front leg;

said walker comprising a crossbar joining said first front leg to said second front leg.

15. The device of claim 14 further comprising a second handrail extender, similarly configured to the first handrail extender.

16. The device of claim 15, wherein said plates further comprise ribbed interior surfaces.

* * * * *